US012133569B2

(12) United States Patent
Agustsson

(10) Patent No.: US 12,133,569 B2
(45) Date of Patent: Nov. 5, 2024

(54) SAFETY HELMET

(71) Applicant: GLOBUS (SHETLAND) LTD., Manchester (GB)

(72) Inventor: Haraldur Agustsson, Manchester (GB)

(73) Assignee: GLOBUS (SHETLAND) LTD., Manchester (GB)

( * ) Notice: Subject to any disclaimer, the term of this patent is extended or adjusted under 35 U.S.C. 154(b) by 175 days.

(21) Appl. No.: 17/774,247

(22) PCT Filed: Nov. 4, 2020

(86) PCT No.: PCT/EP2020/080962

§ 371 (c)(1),
(2) Date: May 4, 2022

(87) PCT Pub. No.: WO2021/089622

PCT Pub. Date: May 14, 2021

(65) Prior Publication Data

US 2022/0386730 A1 Dec. 8, 2022

(30) Foreign Application Priority Data

Nov. 4, 2019 (GB) ..... 1916014

(51) Int. Cl.

| | |
|---|---|
| ***A42B 3/06*** | (2006.01) |
| ***A42B 3/12*** | (2006.01) |
| ***A42B 3/14*** | (2006.01) |

(52) U.S. Cl.

CPC ..... *A42B 3/062* (2013.01); *A42B 3/12* (2013.01); *A42B 3/125* (2013.01); *A42B 3/14* (2013.01)

(58) Field of Classification Search

CPC ..... A42B 3/062; A42B 3/12; A42B 3/125; A42B 3/14

See application file for complete search history.

(56) References Cited

U.S. PATENT DOCUMENTS

| | | | | | |
|---|---|---|---|---|---|
| 3,111,674 | A | * | 11/1963 | Marietta | A42B 3/14 2/414 |
| 3,273,162 | A | | 9/1966 | Andrews | |
| 3,696,440 | A | * | 10/1972 | Littleton | A42B 3/145 2/418 |
| 3,909,846 | A | * | 10/1975 | Zahn | A42B 3/14 2/416 |
| 4,023,213 | A | * | 5/1977 | Rovani | A42B 3/121 2/909 |
| 4,055,860 | A | * | 11/1977 | King | A42B 3/14 2/416 |

(Continued)

FOREIGN PATENT DOCUMENTS

| | | | | |
|---|---|---|---|---|
| AT | 303 408 | | 11/1972 | |
| CN | 202019831 U | * | 11/2011 | A42B 3/04 |

OTHER PUBLICATIONS

Examination Report under Section 18(3) issued in Great Britain Patent Application No. GB1916014.2, dated Jul. 20, 2022.

(Continued)

*Primary Examiner* — Khaled Annis
(74) *Attorney, Agent, or Firm* — NIXON & VANDERHYE

(57) ABSTRACT

Disclosed is a safety helmet including an energy distribution part arranged in a body part of the safety helmet for distributing the energy of an impact in the safety helmet.

8 Claims, 4 Drawing Sheets

(56) References Cited

U.S. PATENT DOCUMENTS

| | | | | | |
|---|---|---|---|---|---|
| 4,307,471 | A * | 12/1981 | Lovell | A42B 3/12 | 2/425 |
| 4,354,283 | A * | 10/1982 | Gooding | A42B 3/14 | 2/413 |
| 4,463,456 | A * | 8/1984 | Hanson | A42B 3/14 | 2/416 |
| 5,121,508 | A * | 6/1992 | Grilliot | A42B 3/08 | 2/5 |
| 5,150,479 | A * | 9/1992 | Oleson | A42B 3/14 | 2/5 |
| 5,177,815 | A * | 1/1993 | Andujar | A42B 3/28 | 2/425 |
| 5,272,773 | A * | 12/1993 | Kamata | A42B 3/08 | 2/421 |
| 5,337,420 | A * | 8/1994 | Haysom | A42B 3/14 | 2/181 |
| 5,713,083 | A * | 2/1998 | King | A42B 1/08 | 2/182.2 |
| 5,774,900 | A * | 7/1998 | Wu | A42B 3/28 | 2/416 |
| 5,898,949 | A * | 5/1999 | Barthold | A42B 3/10 | 2/5 |
| 5,996,126 | A * | 12/1999 | Barthold | A42B 3/14 | 2/416 |
| 6,817,039 | B1 * | 11/2004 | Grilliot | A42B 3/122 | 2/416 |
| 10,517,347 | B2 * | 12/2019 | Suddaby | A42B 3/124 | |
| 10,561,192 | B2 * | 2/2020 | Weber | A42B 3/064 | |
| 11,013,289 | B1 * | 5/2021 | Lucero | A42B 3/30 | |
| 11,678,709 | B2 * | 6/2023 | Halldin | A42B 3/069 | 2/411 |
| 11,812,810 | B2 * | 11/2023 | Pomering | A42B 3/064 | |
| 2002/0000004 | A1 * | 1/2002 | Wise | A42B 3/14 | 2/418 |
| 2012/0198604 | A1 * | 8/2012 | Weber | A42B 3/064 | 2/410 |
| 2013/0042397 | A1 * | 2/2013 | Halldin | A42B 3/12 | 2/411 |
| 2013/0232668 | A1 * | 9/2013 | Suddaby | A42B 3/064 | 2/413 |
| 2013/0232669 | A1 * | 9/2013 | Smith | A42B 3/065 | 2/414 |
| 2014/0109297 | A1 * | 4/2014 | Lanez | A42B 3/04 | 2/411 |
| 2016/0021965 | A1 * | 1/2016 | Mayerovitch | A42B 3/064 | 2/414 |
| 2016/0316847 | A1 * | 11/2016 | Weber | A42B 3/064 | |
| 2017/0245578 | A1 * | 8/2017 | Xiong | A42B 3/147 | |
| 2018/0271198 | A1 * | 9/2018 | Ku | A42B 3/064 | |
| 2019/0328073 | A1 * | 10/2019 | Morgan | A42B 3/124 | |
| 2020/0146385 | A1 * | 5/2020 | Young | A42B 3/064 | |
| 2022/0386730 | A1 * | 12/2022 | Agustsson | A42B 3/062 | |

OTHER PUBLICATIONS

International Search Report for PCT/EP2020/080962 dated Nov. 4, 2020, 4 pages.

Written Opinion of the ISA for PCT/EP2020/080962 dated Nov. 4, 2020, 5 pages.

* cited by examiner

SAFETY HELMET

This application is the U.S. national phase of International Application No. PCT/EP2020/080962 filed Nov. 4, 2020 which designated the U.S. and claims priority to GB 1916014.2 filed Nov. 4, 2019, the entire contents of each of which are hereby incorporated by reference.

FIELD OF THE INVENTION

Generally, the present invention relates to safety helmets. In particular, the present invention pertains to the impact features of safety helmets.

BACKGROUND

A safety helmet, such as a hard hat, is the type of helmet mainly used in work-place environments, such as industrial or construction sites, to protect the head from injury due to falling objects, impact with other objects, debris, rain, and electric shocks.

Helmets typically comprise means, such as suspension parts inside the helmet's body part, for spreading the helmet's weight and the force of any impact over the top of the head. A suspension part typically provides a space between the helmet's body part and the wearer's head, so that if an object strikes the shell, the impact is less likely to be transmitted directly to the skull. Despite the suspension parts, the safety features of helmets still need to be improved.

SUMMARY OF THE INVENTION

The objective is to at least ease the problems described hereinabove not satisfactorily solved by the known arrangements, and to provide a feasible safety helmet for improving impact protection and enhancing personal safety.

The aforesaid objective is achieved according to the present invention, as claimed in claim 1.

Accordingly, in one aspect of the present invention, a safety helmet comprises an energy distribution part arranged in a body part of the safety helmet for distributing the energy of an impact in the safety helmet.

In one embodiment the energy distribution part has a shape of a cross.

In one embodiment the energy distribution part is formed by a wall thickness change.

In one embodiment at least a part of the thickness of the energy distribution part is more than the thickness of the body part.

In one embodiment the energy distribution part is arranged on the inside of the safety helmet.

In one embodiment at least part of the energy distribution part is arranged to a crown area of the safety helmet.

In one embodiment the safety helmet comprises a suspension system.

In one embodiment the energy distribution part is arranged inside the suspension system.

In one embodiment the safety helmet is made of Acrylonitrile Butadiene Styrene (ABS) plastic and/or polycarbonates (PC) plastic.

In one embodiment the safety helmet is made of high-density polyethylene (HDPE) plastic.

The utility of the present invention follows from a plurality of factors depending on each particular embodiment.

Some embodiments of the helmet's structure optimize deflection and force transfer from the crown area, through the energy distribution part, to the sides of the helmet's body part in an efficient way. The energy may be distributed and dissipated equally, thus keeping force transfer to the head of the wearer low.

The cross design of the energy distribution part has advantages, such as it may allow an even and/or smooth transfer of energy to the sides of the body part. A wall thickness change in the energy distribution part may enable a simple and inexpensive way to manufacture the helmet.

The cross shape on the inside crown area may be able to optimize deflection (i.e. deformation of the crown) to the point it does not touch the head form, but still allows enough deformation, so that the force transfer to the head is not too high. The cross shape may optimize the balance between flexible (i.e. not too rigid) reduced force transfer to the head and too much deflection where the crown concaves in and touches the head form in EN397 testing.

The safety helmet of the present invention may help to extend the time taken to transfer the energy of the impact, thereby minimizing it, transitioning it smoothly to the sides and the suspension system.

The expression "a number of" refers herein to any positive integer starting from one (1), e.g. to one, two or three.

The expression "a plurality of" refers herein to any positive integer starting from two (2), e.g. to two, three or four.

Different embodiments of the present invention are disclosed in the dependent claims.

BRIEF DESCRIPTION OF THE RELATED DRAWINGS

Next the invention is described in more detail with reference to the appended drawings in which FIG. 1 illustrates a perspective view of an embodiment of a safety helmet in accordance with the present invention.

DETAILED DESCRIPTION OF THE EMBODIMENTS

Figure 1:
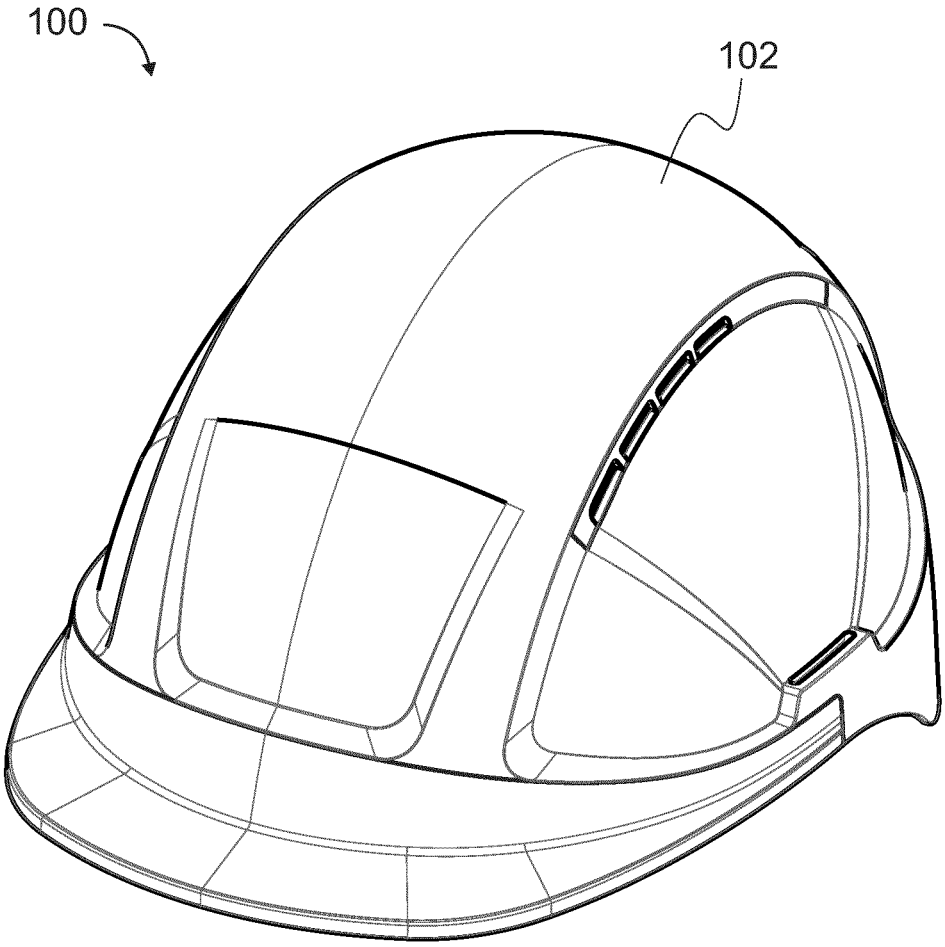
Figure 2:
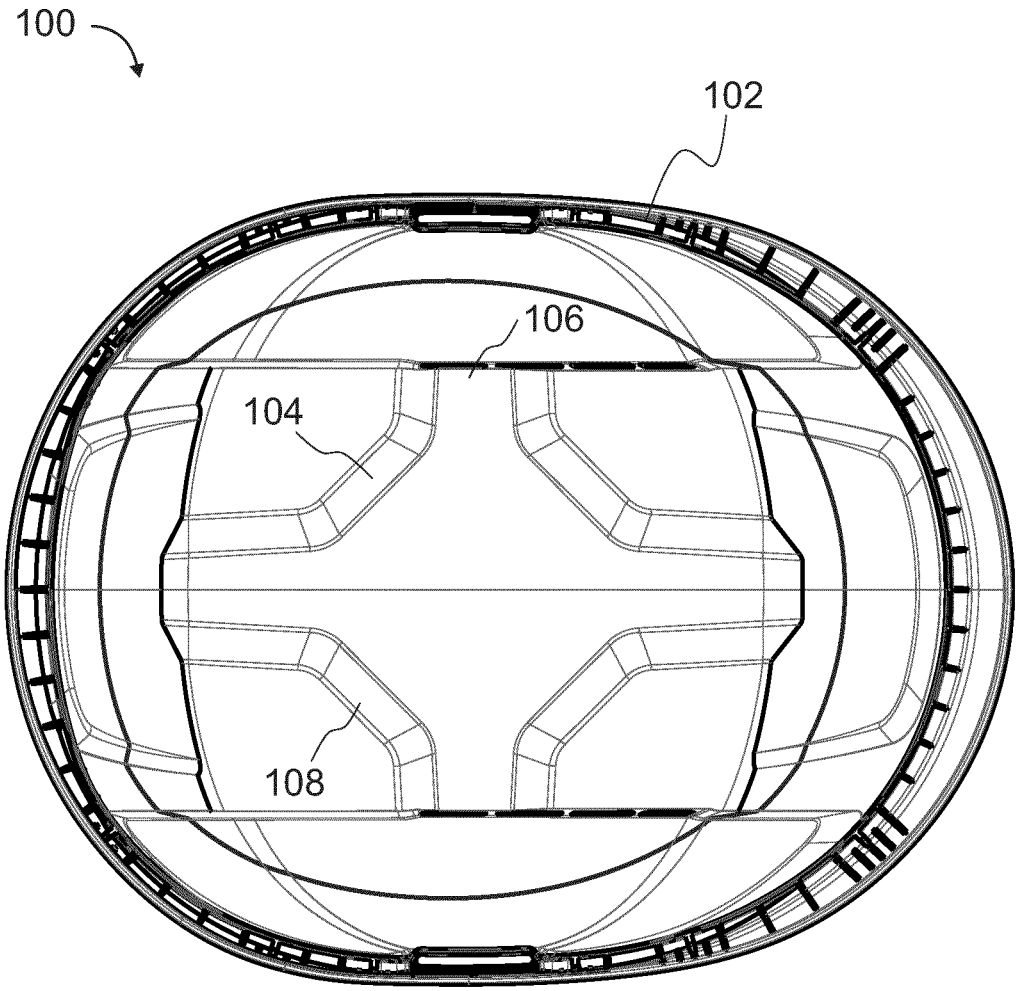
FIG. 2 illustrates a bottom view of the safety helmet.
Figure 3:
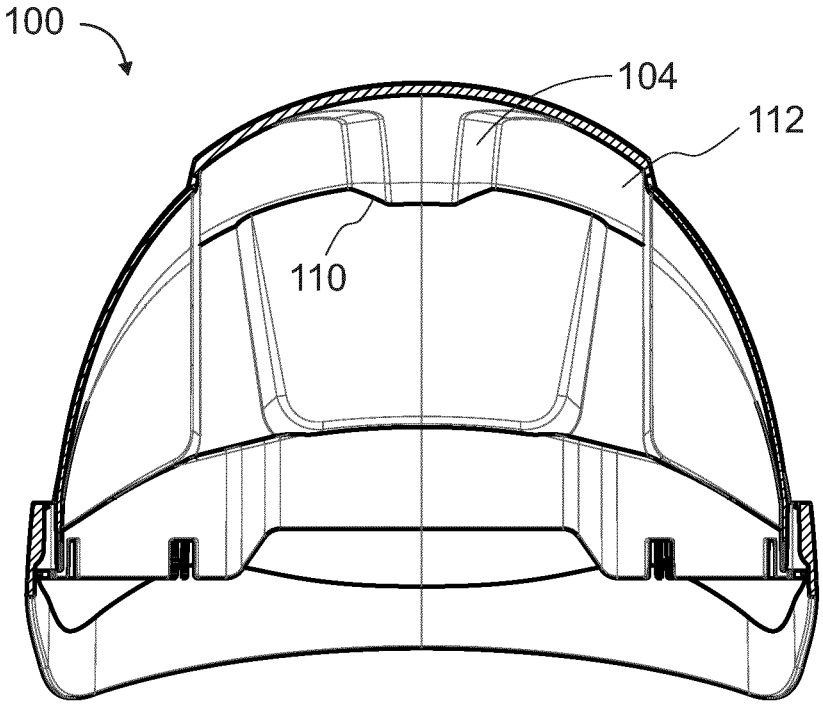
FIG. 3 illustrates a cross-section of the rear view of the safety helmet.
Figure 4:
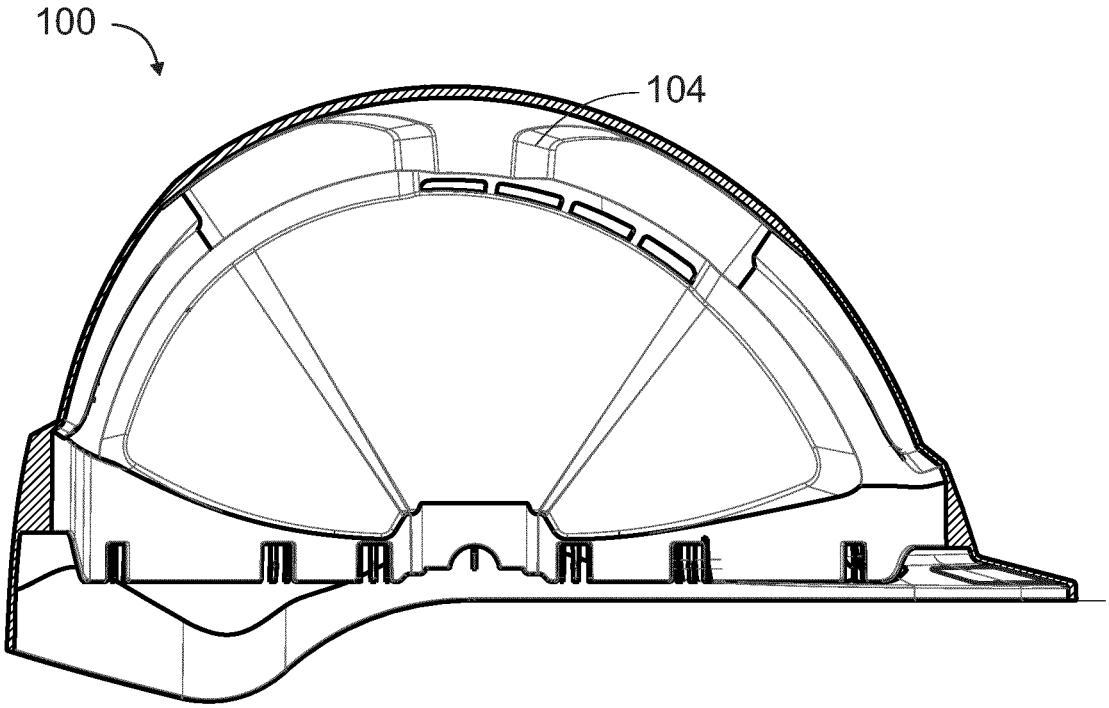
FIG. 4 illustrates a cross-section of the side view of the safety helmet
Figure 5:
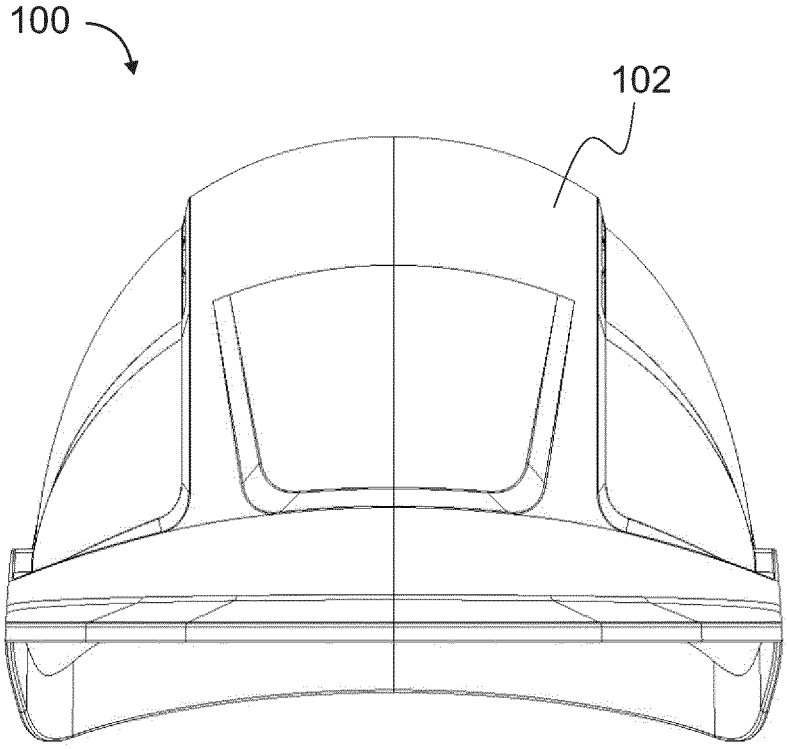
FIG. 5 illustrates a front view of the safety helmet.

Referring to FIGS. 1-5, the safety helmet 100 comprises a body part 102 and an energy distribution part 104.

The energy distribution part 104 is arranged to the body part 102 of the safety helmet 100 for distributing the energy of an impact in the safety helmet 100. The energy distribution part 104 is arranged to the inside of the safety helmet to the crown area 106.

The energy distribution part 104 has the shape of a cross 108. The shape may be formed by a wall thickness change 110 relative to the body part 102. The wall thickness change 110 may be an embossed feature such as a protrusion form. The edges of the energy distribution part 104 may taper down in order to transit smoothly the energy of an impact.

At least a part of the wall thickness of the energy distribution part 104 is more than the wall thickness of the body part 102. The body part 102 may have a wall thickness of approximately 1.5-2 mm in the crown area. The energy distribution part 104 may have a wall thickness of approximately 3-10 mm.

The energy distribution part 104 is arranged inside the suspension system 112 of the safety helmet 100.

The crown area 106 may be 110 mm or 120 mm, for example.

The safety helmet 100 may be made of acrylonitrile butadiene styrene (ABS), polycarbonates (PC), polycarbonate glass fibre, polyamide (e.g. Nylon 6), high-density polyethylene (HDPE), low density polyethylene or polyoxymethylene (POM), for example.

Consequently, a skilled person may, on the basis of this disclosure and general knowledge, apply the provided teachings in order to implement the scope of the present invention as defined by the appended claims in each particular case of use with the necessary modifications, deletions and additions.

The invention claimed is:

1. A safety helmet comprising:

a body part with a crown area and sides located below the crown area, the body part including an energy distribution part formed on an inside of the body part, the energy distribution part being defined by a wall thickness change of the body part so that at least a part of a thickness of the energy distribution part is more than a thickness of the body part to transfer force from a top of the body part, through the energy distribution part, to the sides of the body part, the energy distribution part distributing energy of an impact in the safety helmet, the body part and the energy distribution part being formed of a same material.

2. The safety helmet according to claim 1, wherein the energy distribution part has a shape of a cross.

3. The safety helmet according to claim 2, wherein at least part of the energy distribution part is arranged to the crown area of the safety helmet.

4. The safety helmet according to claim 2, further comprising a suspension system.

5. The safety helmet according to claim 1, wherein at least part of the energy distribution part is arranged to the crown area of the safety helmet.

6. The safety helmet according to claim 1, further comprising a suspension system.

7. The safety helmet according to claim 1, wherein the safety helmet is made of polycarbonates (PC), polycarbonate glass fiber, polyamide, high-density polyethylene (HDPE), low density polyethylene or polyoxymethylene (POM).

8. The safety helmet of claim 1, further comprising a suspension system, wherein at least part of the energy distribution part is arranged inside the suspension system on the inside of the crown area of the body part, wherein a shape of the energy distribution part inside the crown area is a cross shape, and wherein the wall thickness of the energy distribution part changes relative to the body part with edges of the energy distribution part tapering down from a top of the crown area to deflect and transfer force from the crown area, through the energy distribution part, to the sides of the helmet.

* * * * *